US009750315B2

(12) United States Patent
Ng

(10) Patent No.: US 9,750,315 B2
(45) **Date of Patent: *Sep. 5, 2017**

(54) DEVICE FOR FORMING BRUNNIAN LINKS

(71) Applicant: Choon's Design LLC, Wixom, MI (US)

(72) Inventor: Cheong Choon Ng, Novi, MI (US)

(73) Assignee: Choon's Design LLC, Wixom, MI (US)

( * ) Notice: Subject to any disclaimer, the term of this patent is extended or adjusted under 35 U.S.C. 154(b) by 61 days.

This patent is subject to a terminal disclaimer.

(21) Appl. No.: 14/641,874

(22) Filed: Mar. 9, 2015

(65) Prior Publication Data

US 2015/0173467 A1 Jun. 25, 2015

Related U.S. Application Data

(63) Continuation of application No. 14/270,635, filed on May 6, 2014, now Pat. No. 8,973,955, which is a (Continued)

(51) Int. Cl.
*A44C 5/00* (2006.01)
*D03D 29/00* (2006.01)

(Continued)

(52) U.S. Cl.
CPC ..... *A44C 5/0069* (2013.01); *A44C 27/00* (2013.01); *B65H 69/04* (2013.01); *D03D 29/00* (2013.01);

(Continued)

(58) Field of Classification Search
CPC .... D07B 1/02; D07B 1/04; D07B 1/14; B63B 21/20
See application file for complete search history.

(56) References Cited

U.S. PATENT DOCUMENTS 38,192 A 4/1863 Wilcox
86,119 A 1/1869 Allport (Continued)

FOREIGN PATENT DOCUMENTS

CH 201594 11/1937
DE 521894 3/1931

(Continued)

OTHER PUBLICATIONS

International Search Report and Written Opinion for International Application No. PCT/US2015/026280 mailed Jul. 14, 2015.

(Continued)

*Primary Examiner* — Shaun R Hurley
(74) *Attorney, Agent, or Firm* — Carlson, Gaskey & Olds, P.C.

(57) ABSTRACT

A Brunnian link is a link formed from a closed loop doubled over itself to capture another closed loop to form a chain. Elastic bands can be utilized to form such links in a desired manner. The example device provides a means of creating items using Brunnian links of complex configurations. Moreover, the example kit provides a device that allows for the successful creation of unique linked items.

14 Claims, 4 Drawing Sheets

Related U.S. Application Data continuation-in-part of application No. 13/938,717, filed on Jul. 10, 2013, now Pat. No. 8,955,888, which is a continuation of application No. 13/227,638, filed on Sep. 8, 2011, now Pat. No. 8,485,565.

(60) Provisional application No. 61/410,399, filed on Nov. 5, 2010, provisional application No. 61/877,480, filed on Sep. 13, 2013.

(51) Int. Cl.

| | |
|---|---|
| ***A44C 27/00*** | (2006.01) |
| ***B65H 69/04*** | (2006.01) |
| ***D04D 7/02*** | (2006.01) |
| ***D04D 7/04*** | (2006.01) |
| ***D04D 11/00*** | (2006.01) |

(52) U.S. Cl.

CPC ..... *D04D 7/02* (2013.01); *D04D 7/04* (2013.01); *D04D 11/00* (2013.01)

(56) References Cited

U.S. PATENT DOCUMENTS

| | | | |
|---|---|---|---|
| 222,937 | A | 12/1879 | Newcomb |
| 246,648 | A | 9/1881 | Wilcox |
| 254,258 | A | 2/1882 | Barbour |
| 254,288 | A | 2/1882 | Dimmick |
| 289,578 | A | 12/1883 | Stewart |
| 426,087 | A | 4/1890 | Wolkow |
| 763,303 | A | 6/1904 | Mayers |
| 782,657 | A | 2/1905 | Hubert |
| 843,495 | A | 2/1907 | Sander |
| 904,747 | A | 11/1908 | Anderson |
| 968,199 | A | 8/1910 | Schwartz |
| 1,020,963 | A | 3/1912 | Cake |
| 1,073,226 | A | 9/1913 | Freeman |
| 1,176,482 | A | 3/1916 | Orme |
| D51,186 | S | 8/1917 | Pearson |
| 1,279,411 | A | 9/1918 | Neuman |
| 1,318,465 | A | 10/1919 | Seifarth |
| 1,318,604 | A | 10/1919 | Schneider |
| 1,366,212 | A | 1/1921 | Pollard |
| 1,375,119 | A | 4/1921 | Stephen |
| 1,405,744 | A | 2/1922 | Sampliner |
| 1,424,458 | A | 8/1922 | Fleisher |
| 1,500,383 | A | 7/1924 | Gourie |
| 1,599,040 | A | 9/1926 | Clisby |
| 1,647,060 | A | 10/1927 | Speidel |
| 1,694,849 | A | 12/1928 | Fujii |
| 1,705,860 | A | 3/1929 | Hagihara |
| 1,718,140 | A | 6/1929 | Hagihara |
| 1,776,561 | A | 9/1930 | La Croix |
| 1,878,861 | A | 9/1932 | Krasnow |
| 1,994,659 | A | 3/1935 | De A Mascarenhas |
| 2,072,668 | A | 3/1937 | Eltgroth |
| 2,108,424 | A | 2/1938 | Bakely |
| 2,134,066 | A | 10/1938 | Van Ness |
| 2,186,692 | A | 1/1940 | Boyer et al. |
| 2,237,733 | A | 4/1941 | Grimm et al. |
| 2,270,619 | A | 1/1942 | Bowyer |
| 2,274,572 | A | 2/1942 | Yates |
| 2,318,018 | A | 5/1943 | Semonsen |
| 2,360,416 | A | 10/1944 | Gray |
| D144,079 | S | 3/1946 | Smith |
| D146,830 | S | 5/1947 | Kimmelstiel |
| 2,433,307 | A | 12/1947 | Thomas |
| 2,450,067 | A | 9/1948 | Wolff |
| 2,457,064 | A | 12/1948 | Parisi |
| 2,540,383 | A | 2/1951 | Tillert et al. |
| 2,545,409 | A | 3/1951 | McCall |
| 2,600,091 | A | 6/1952 | Becker |
| D167,727 | S | 9/1952 | Teare |
| 2,658,364 | A | 11/1953 | Carlson |
| 2,666,249 | A | 1/1954 | Ruiz et al. |
| 2,687,630 | A | 8/1954 | Carlson |
| 2,703,482 | A | 3/1955 | Auran |
| 2,707,052 | A | 4/1955 | Brown |
| 2,726,434 | A | 12/1955 | Knoblock et al. |
| 2,984,488 | A | 5/1961 | Kirchner |
| 3,054,214 | A | 9/1962 | Smith et al. |
| 3,069,739 | A | 12/1962 | Jorgenson et al. |
| 3,112,491 | A | 12/1963 | Cleveland |
| D204,442 | S | 4/1966 | Brawley, Jr. |
| 3,276,181 | A | 10/1966 | Gilbert |
| 3,377,674 | A | 4/1968 | Brassaw et al. |
| 3,438,098 | A | 4/1969 | Grabner |
| 3,438,223 | A | 4/1969 | Linstead |
| 3,476,423 | A | 11/1969 | Kentfield |
| 3,476,426 | A | 11/1969 | Lewin |
| 3,572,679 | A | 3/1971 | Strauff |
| 3,636,987 | A | 1/1972 | Forby |
| 3,648,484 | A | 3/1972 | Gordon |
| 3,665,971 | A | 5/1972 | Ileks |
| 3,672,679 | A | 6/1972 | Burns |
| 3,678,709 | A | 7/1972 | Nowicki et al. |
| 3,688,357 | A | 9/1972 | Nielsen et al. |
| 3,693,976 | A | 9/1972 | Flack |
| 3,728,762 | A | 4/1973 | Hogg |
| 3,748,706 | A | 7/1973 | Doyel |
| 3,758,923 | A | 9/1973 | Maude |
| 3,800,372 | A | 4/1974 | Daoust |
| 3,805,345 | A | 4/1974 | Antos |
| 3,853,021 | A | 12/1974 | Hayes |
| 3,905,133 | A | 9/1975 | Charman |
| D238,812 | S | 2/1976 | Fioretti |
| 4,018,543 | A | 4/1977 | Carson et al. |
| 4,023,245 | A | 5/1977 | Zaltzman |
| 4,032,179 | A | 6/1977 | Goss |
| 4,037,513 | A | 7/1977 | Hobson |
| D245,748 | S | 9/1977 | Ostroll |
| 4,066,271 | A | 1/1978 | Lohr |
| D248,347 | S | 7/1978 | McCollum |
| 4,114,892 | A | 9/1978 | Csoka |
| 4,131,138 | A | 12/1978 | Boisvert |
| 4,179,129 | A | 12/1979 | Loomis |
| D257,257 | S | 10/1980 | McArthur |
| 4,248,063 | A | 2/1981 | Wang |
| 4,416,040 | A | 11/1983 | Towsley |
| D279,938 | S | 8/1985 | Okada |
| 4,569,108 | A | 2/1986 | Schwab |
| 4,629,100 | A | 12/1986 | Owens |
| 4,667,965 | A | 5/1987 | Helms, Jr. |
| 4,680,021 | A | 7/1987 | Maxim |
| 4,729,229 | A | 3/1988 | Whicker |
| 4,844,473 | A | 7/1989 | Landsberg |
| D310,672 | S | 9/1990 | Harvey et al. |
| D330,668 | S | 11/1992 | Nagamatsu |
| 5,163,946 | A | 11/1992 | Li |
| 5,231,742 | A | 8/1993 | Macbain |
| 5,295,280 | A | 3/1994 | Hudson et al. |
| 5,328,374 | A | 7/1994 | Stevens |
| 5,331,725 | A | 7/1994 | Chou |
| 5,377,595 | A | 1/1995 | Liu |
| 5,426,788 | A | 6/1995 | Meltzer |
| 5,437,459 | A | 8/1995 | Kirby |
| 5,459,905 | A | 10/1995 | Voyre |
| 5,577,299 | A | 11/1996 | Thompson et al. |
| 5,639,090 | A | 6/1997 | Stevens |
| 5,687,775 | A | 11/1997 | Thompson et al. |
| D389,050 | S | 1/1998 | Li |
| 5,713,094 | A | 2/1998 | Markey et al. |
| D406,749 | S | 3/1999 | Selk |
| 5,888,392 | A | 3/1999 | Frizell |
| 5,927,764 | A | 7/1999 | Harriman |
| D425,784 | S | 5/2000 | Beugelsdyk et al. |
| 6,065,968 | A | 5/2000 | Corliss |
| D426,425 | S | 6/2000 | Hermanski |
| 6,122,859 | A | 9/2000 | Lazar |
| 6,129,551 | A | 10/2000 | Martin |
| 6,131,778 | A | 10/2000 | Etzion |
| 6,146,144 | A | 11/2000 | Fowler et al. |
| 6,149,436 | A | 11/2000 | Dunn |
| 6,171,317 | B1 | 1/2001 | Jackson et al. |

(56) References Cited

U.S. PATENT DOCUMENTS

| | | | | |
|---|---|---|---|---|
| 6,213,918 | B1 | 4/2001 | Rogers, Jr. | |
| 6,389,652 | B1 | 5/2002 | Williams | |
| 6,550,177 | B1 | 4/2003 | Epple, Jr. | |
| D478,738 | S | 8/2003 | Workman | |
| 6,880,364 | B1 | 4/2005 | Vidolin et al. | |
| 6,902,212 | B1 | 6/2005 | Mize | |
| 6,923,026 | B1 | 8/2005 | Clarke | |
| 7,040,120 | B2 | 5/2006 | Hunter | |
| D522,352 | S | 6/2006 | Van Straaten | |
| D552,463 | S | 10/2007 | French et al. | |
| D562,358 | S | 2/2008 | Landmesser | |
| D563,997 | S | 3/2008 | Gustin | |
| D570,923 | S | 6/2008 | Vazquez Gastellu | |
| D578,383 | S | 10/2008 | Adams | |
| 7,506,524 | B2 | 3/2009 | Gustin | |
| D592,537 | S | 5/2009 | Darnell | |
| 7,578,146 | B2 | 8/2009 | Gustin | |
| 7,617,947 | B2 | 11/2009 | Schafer | |
| D608,189 | S | 1/2010 | Jackson et al. | |
| 7,677,677 | B1 | 3/2010 | Roberts | |
| 7,909,609 | B2 | 3/2011 | Molin | |
| D635,594 | S | 4/2011 | Novak | |
| D639,683 | S | 6/2011 | Essel | |
| 8,316,894 | B2 | 11/2012 | Schaub | |
| 8,402,794 | B2 | 3/2013 | Sasur | |
| 8,418,434 | B1 | 4/2013 | Carruth et al. | |
| 8,485,565 | B2 | 7/2013 | Ng | |
| 8,510,916 | B2 | 8/2013 | Kinvi | |
| D690,191 | S | 9/2013 | Takakuwa et al. | |
| D696,576 | S | 12/2013 | Ng | |
| 8,622,441 | B1 | 1/2014 | Ng | |
| 8,684,420 | B2 | 4/2014 | Ng | |
| D711,931 | S | 8/2014 | Daftari | |
| 8,936,283 | B2 * | 1/2015 | Ng | A44C 5/0069 289/17 |
| 8,955,888 | B2 * | 2/2015 | Ng | A44C 5/0069 289/17 |
| 8,973,955 | B2 * | 3/2015 | Ng | A44C 27/00 289/17 |
| 2004/0079109 | A1 | 4/2004 | Crova | |
| 2007/0114340 | A1 | 5/2007 | Adams | |
| 2007/0199965 | A1 | 8/2007 | Gouldson | |
| 2008/0156043 | A1 | 7/2008 | Gustin | |
| 2008/0223083 | A1 | 9/2008 | Gustin | |
| 2009/0215013 | A1 | 8/2009 | Molin | |
| 2010/0019495 | A1 | 1/2010 | Oliveto | |
| 2011/0067558 | A1 | 3/2011 | Saindon | |
| 2011/0152946 | A1 | 6/2011 | Frigg et al. | |
| 2011/0259465 | A1 | 10/2011 | Schaub | |
| 2012/0047960 | A1 | 3/2012 | Sasur | |
| 2012/0112457 | A1 | 5/2012 | Ng | |
| 2012/0150203 | A1 | 6/2012 | Brady et al. | |
| 2013/0020802 | A1 | 1/2013 | Ng | |
| 2013/0300114 | A1 | 11/2013 | Ng | |
| 2013/0307267 | A1 | 11/2013 | Ng | |
| 2014/0373966 | A1 | 12/2014 | Nedry et al. | |
| 2015/0296937 | A1 * | 10/2015 | Ng | D04D 11/00 289/17 |

FOREIGN PATENT DOCUMENTS

| | | |
|---|---|---|
| GB | 2147918 | 5/1985 |
| JP | S03-001676 Y | 2/1928 |
| JP | H09291447 | 11/1997 |
| JP | 2003-171854 A | 6/2003 |
| JP | 2003-520083 | 7/2003 |
| JP | 2004-520910 | 7/2004 |
| JP | D1393632 | 8/2010 |
| JP | D1501836 | 7/2014 |
| JP | D1501837 | 7/2014 |
| KR | 10-2001-0012609 | 2/2001 |
| KR | 10-2006-0042108 | 5/2006 |
| KR | 300503642 | 5/2008 |
| WO | 2012/060906 A1 | 5/2012 |
| WO | 2014/190255 A1 | 11/2014 |

OTHER PUBLICATIONS

Helmet Strap Quick Release Clip, catalog added date Nov. 10, 2011, online, http://allbrandsofthings.com/index.php?main_page=product_info&cPath=33&products_id=457&zenid=adrmed661oj5gqu9dlhqpqgmm7.

Amazon.com—Plastic Trash Can Bag Clip Clamp, review date Feb. 19, 2014, online, http://www.amazon.com/Plastic-Garbage-Rubbish-Trash-Holder/dp/B00E6Q0DQ0/ref=sr.

International Search Report & Written Opinion for International Application No. PCT/US2011/041553 mailed on Feb. 23, 2012.

International Preliminary Report on Patentability for International Application No. PCT/US2011/041553 mailed on May 16, 2013.

United Kingdom Combined Search and Examination Report for Application No. GB1416090.1 dated Oct. 16, 2014.

United Kingdom Combined Search and Examination Report for Application No. GB1416091.5 dated Oct. 16, 2014.

International Search Report and Written Opinion for International Application No. PCT/US14/46106 mailed Oct. 18, 2014.

International Search Report and Written Opinion for International Application No. PCT/US14/54475 mailed Oct. 27, 2014.

How to make a fishtail rainbow loom bracelet; http://www.youtube.com/watch?v=ukv83Cvq3jk; Jul. 13, 2013.

European Search Report for EP Application No. 13840473.6 dated Jul. 3, 2014.

Petition for Post-Grant Review of U.S. Pat. No. 8,684,420 and Exhibits, filed in the United States Patent and Trademark Office on Aug. 5, 2014, Case No. PGR2014-00008.

Petition for Inter Partes Review of U.S. Pat. No. 8,485,565 and Exhibits, filed in the United States Patent and Trademark Office on Aug. 20, 2014, Case No. IPR2014-01353.

Takacas, Sarah (SarahLynnTea), How to Make Rubber Band Bracelets; Published Apr. 15, 2009 http://www.youtube.com/watch?v=e0k762PJ-D8.

Introduction video—Rainbow Loom (the next generation Twistz Bandz kit). Published Sep. 24, 2012. http://www.youtube.com/watch?v=FUwf3CheGuw.

Lesson 21: "Sweet Heart" Rainbow Loom Bracelet by Choon; Published Jan. 21, 2013 http://www.youtube.com/watch?v=718MbYceEC0.

Rainbow Loom from Choon's Design, LLC; Published Jul. 24, 2013 http://www.youtube.com/watch?v=vhiVxnbE0CE.

How to make a rainbow loom starburst bracelet; Published Aug. 1, 2013 http://www.youtube.com/watch?v=RI7AkI5dJzo.

How to: Make the Rainbow Loom Single Band Bracelet; Published Aug. 12, 2013 http://www.youtube.com/watch?v=Wd3UdqPmKbA.

European Search Report for EP Application No. 14184498.5 dated Jan. 26, 2015.

International Preliminary Report on Patentability for International Application No. PCT/US2013/060890 mailed Apr. 9, 2015.

Petition for Inter Partes Review of U.S. Pat. No. 8,622,441 and Exhibits, filed in the United States Patent and Trademark Office on Mar. 3, 2015, Case No. IPR2015-00840.

Norris, Kathy, I Can't Believe I'm Loom Knitting!, www.leisurearts.com, 2010.

Phelps, Isela, Loom Knitting Primer: A Beginner's Guide to Knitting on a Loom with Over 30 Fun Projects, 2007.

Lijovich, Basic Instructions for Using a Double Lucet, Jan. 2002, revised Jun. 2002.

The Horde of Vigdis, Aug. 5, 2011.

International Search Report and Written Opinion for International Application No. PCT/US2013/060890 mailed Jan. 2, 2014.

International Preliminary Report on Patentability for International Application No. PCT/US2014/054475 mailed Mar. 24, 2016.

Petition for Inter Partes Review of U.S. Pat. No. 8,485,565 and Exhibits, filed in the United States Patent and Trademark Office on Mar. 3, 2015, Case No. IPR2015-00838.

(56) References Cited

OTHER PUBLICATIONS

Petition for Inter Partes Review of U.S. Pat. No. 8,485,565 and Exhibits, filed in the United States Patent and Trademark Office on May 1, 2015, Case No. IPR2015-01139.
Petition for Inter Partes Review of U.S. Pat. No. 8,684,420 and Exhibits, filed in the United States Patent and Trademark Office on May 4, 2015, Case No. IPR2015-01143.
Phelps, Isela, Loom Knitting Primer: A Beginner's Guide to Knitting on a Loom with Over 30 Fun Projects, 2007, pp. 12-20, 99, and 118.
Phelps, Isela G., Loom Knitting Basics: Knitting in the Round, www.dalooms.com, 2001.
How to Make a Homemade Geoboard, http://www.feelslikehomeblog.com/2010/02/how-to-make-a-geoboard/, Feb. 21, 2010.
Bipes, Anne, Loom Knitting Getting Started on the Round Loom, www.loomknitting.com, 2005.
How to Make Rubber Band Bracelets Using Twistz Bandz—Instruction #1; http://www.youtube.com/watch?v=6nInnVEjrLU; Mar. 28, 2011.
Various rubber band crafts and bracelets using Rainbow Loom®; http://www.youtube.com/watch?v=oM6sOkZFz5o; Mar. 30, 2011.
How to make "Diamond" pattern rubber band bracelet using the Rainbow Loom® Kit; http://www.youtube.com/watch?v=dZa8dpZasKA; Jun. 8, 2011.
(Rainbow Loom®) Twistz Bandz product—with bloopers; http://www.youtube.com/watch?v=DbzS5u8ib_0; Jul. 6, 2011.
Defendants' Preliminary Non-Binding Invalidity Contentions, *Choon's Design LLC* v. *Zenacon, LLC et al*., United States District Court for the Eastern District of Michigan, Case No. 2:13-cv-13568-PJD-RSW, Mar. 7, 2014.
Decision to Institute of Inter Partes Review of U.S. Pat. No. 8,485,565 dated May 20, 2014, Case IPR2014-00218, from the United States Patent and Trademark Office.
Petitioners Request for Rehearing Under 37 CFR §42.71(d) filed on Jun. 3, 2014, Case IPR2014-00218, from the United States Patent and Trademark Office.
U.S. Appl. No. 13/938,717, filed Jul. 10, 2013, entitled "Brunnian Link Making Device and Kit".
U.S. Appl. No. 14/329,099, filed Jul. 11, 2014, entitled "Brunnian Link Making Device and Kit".
U.S. Appl. No. 13/626,057, filed Sep. 25, 2012, entitled "Brunnian Link Making Device and Kit".
U.S. Appl. No. 14/331,456, filed Jul. 15, 2014, entitled "Hand Held Link Making Device and Kit".
U.S. Appl. No. 14/270,635, filed May 6, 2014, entitled "Device for Forming Brunnian Links".
Design U.S. Appl. No. 29/468,891, filed Oct. 24, 2013, entitled "Brunnian Link Forming Loom".
Design U.S. Appl. No. 29/468,549, filed Oct. 1, 2013, entitled "Brunnian Link Forming Loom".
U.S. Appl. No. 14/226,096, filed Mar. 26, 2014, entitled "Monster Tail Loom for Forming Brunnian Links".
International Search Report and Written Opinion for International Application No. PCT/US14/54492 mailed Jan. 5, 2015.
European Search Report for EP Application No. 14184490.2 dated Dec. 23, 2014.
European Search Report for EP Application No. 14177709.4 dated Nov. 18, 2014.
Petition for Inter Partes Review of U.S. Pat. No. 8,485,565 and Exhibits, filed in the United States Patent and Trademark Office on Dec. 3, 2013, Case No. IPR2014-00218.
Renz, Katie, Provo Craft—Knifty Knitter, CraftCritique.com, http://www.craftcritique.com/2008/09/19/provo-craft-knifty-knitter/, Sep. 19, 2008.
Finger Weave Jump Rope, http://www.makingfriends.com/jump_rope_htm, Date Unknown.

* cited by examiner

DEVICE FOR FORMING BRUNNIAN LINKS

CROSS REFERENCE TO RELATED APPLICATIONS

This application is a continuation of U.S. patent application Ser. No. 14/270,635 filed May 6, 2014, now granted U.S. Pat. No. 8,973,955 which is a continuation-in-part of U.S. patent application Ser. No. 13/938,717 filed Jul. 10, 2013, now granted U.S. Pat. No. 8,955,888, which is a continuation of U.S. patent application Ser. No. 13/227,638 filed Sep. 8, 2011, now granted as U.S. Pat. No. 8,485,565, which claims priority to U.S. Provisional Application No. 61/410,399 filed on Nov. 5, 2010. U.S. patent application Ser. No. 14/270,635 also claims priority to U.S. Provisional Application No. 61/877,480 filed Sep. 13, 2013.

BACKGROUND

This disclosure generally relates to method and device for creating a linked item. More particularly, this disclosure relates to a method and device for creating a linked wearable item from elastic bands.

Kits that include materials for making a uniquely colored bracelet or necklace have always enjoyed some popularity. However such kits usually just include the raw materials such as different colored threads and beads and rely on the individual's skill and talent to construct a usable and desirable item. Accordingly there is a need and desire for a kit that provides not only the materials for creating a unique wearable item, but also that provides for ease of construction to make it easy for people of many skill and artistic levels to successfully create a desirable and durable wearable item.

SUMMARY

A Brunnian link is a link formed from a closed loop doubled over itself to capture another closed loop to form a chain. Elastic bands can be utilized to form such links in a desired manner. The example device provides a means of creating items using Brunnian links of complex configurations. Moreover, the example kit provides a device that allows for the successful creation of unique wearable items regardless of skill level.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
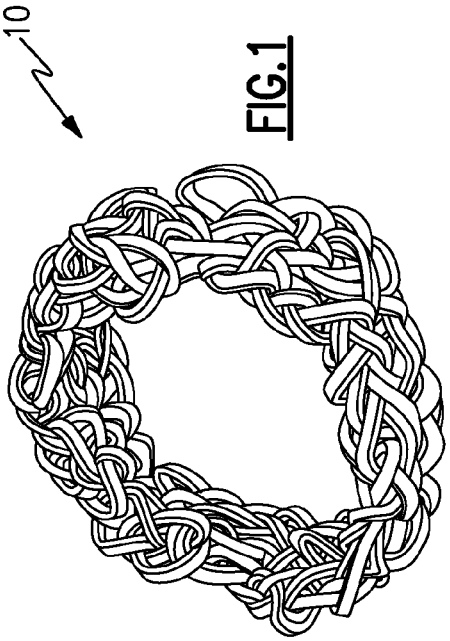
FIG. 1 is a schematic view of an example linked article.
Figure 2:
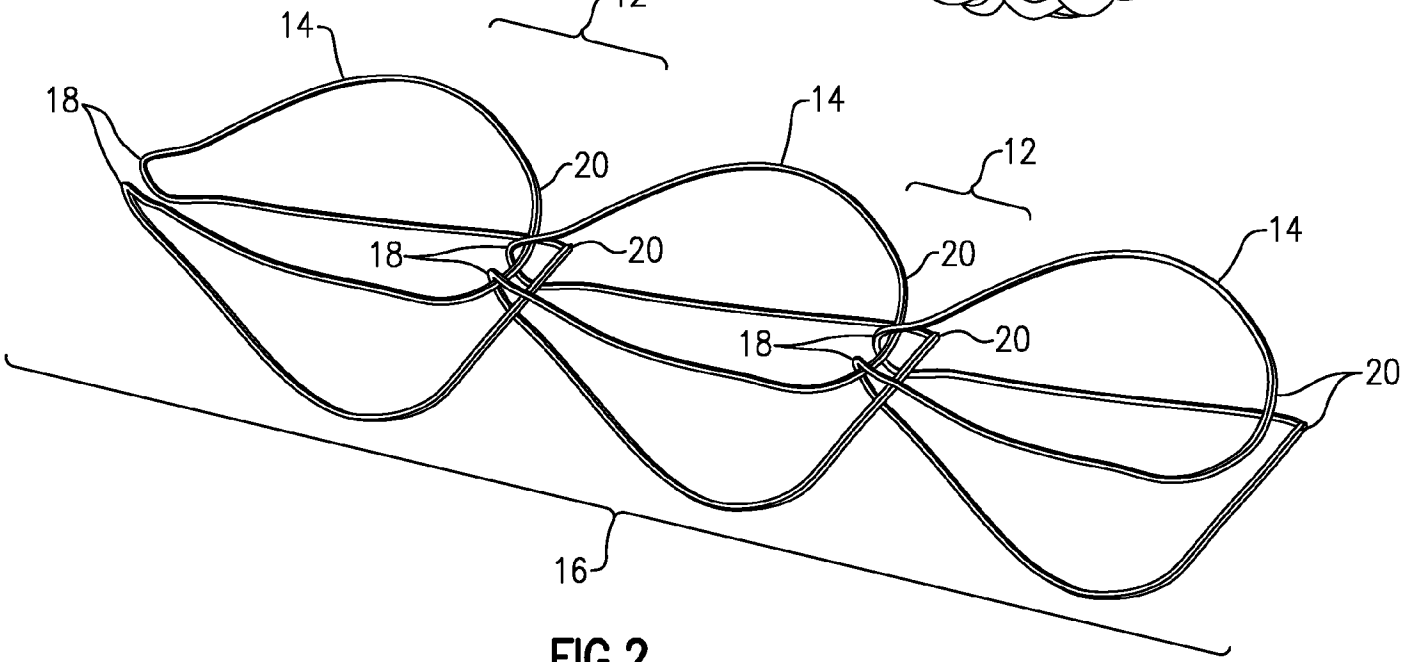
FIG. 2 is a schematic view of an example Brunnian link formed from elastic bands.

Referring to FIGS. 1 and 2, a Brunnian link 12 is formed from a continuous looped structure 14 without forming an actual knot. Several links 12 are formed into a chain 16 to form a linked article such as a bracelet 10. The ends are then secured and a durable wearable item 10 is created. In this example three closed looped elastic bands 14 such as rubber bands are shown forming a single chain. Capturing ends 18 of one elastic band 14 with a mid portion 20 of another elastic band 14 forms each link 12. Each link 12 depends on the previous and subsequent links 14 to maintain the desired linked article.

Figures 3, 4:
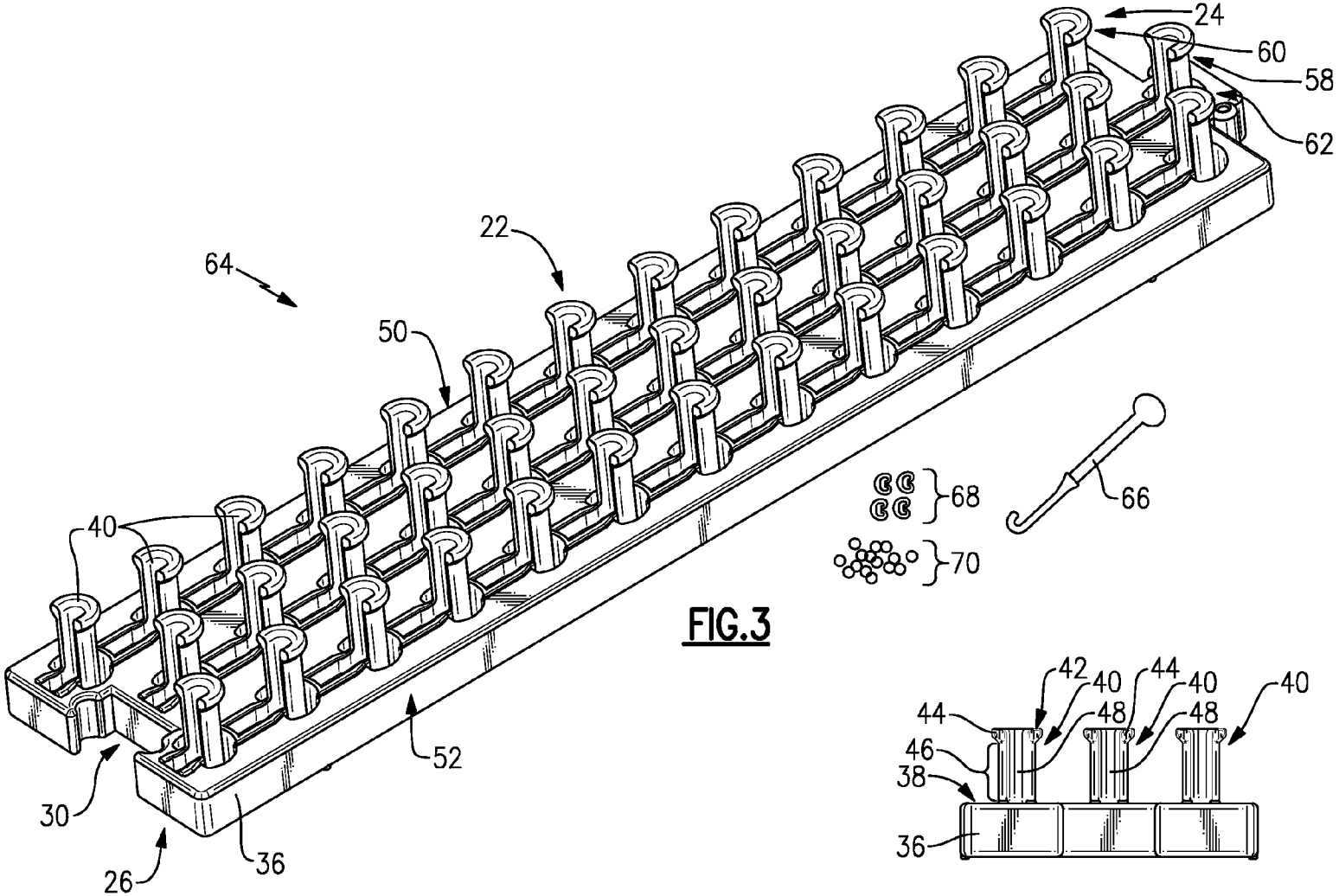
FIG. 3 is a schematic view of an example kit for making Brunnian link articles from elastic bands.
FIG. 4 is a sectional view of an example loom.

Referring to FIGS. 3 and 4, an example kit 64 for creating Brunnian link items such as bracelets and other wearable or decorative items includes a loom 22, a hook 66, a plurality of clips 68 and a plurality of elastic bands 70. The loom 22 includes a base 36 and a plurality of pins 40 standing up from the base 36. The base 36 includes a first surface 38 from which the pins 40 extend. Each of the pins 40 includes a top surface 42 and a flange 44 for holding an elastic band in a desired orientation. In this example, the flange 44 extends from a first side of the access groove 48 to a second side of the access groove 48.

Figure 5:
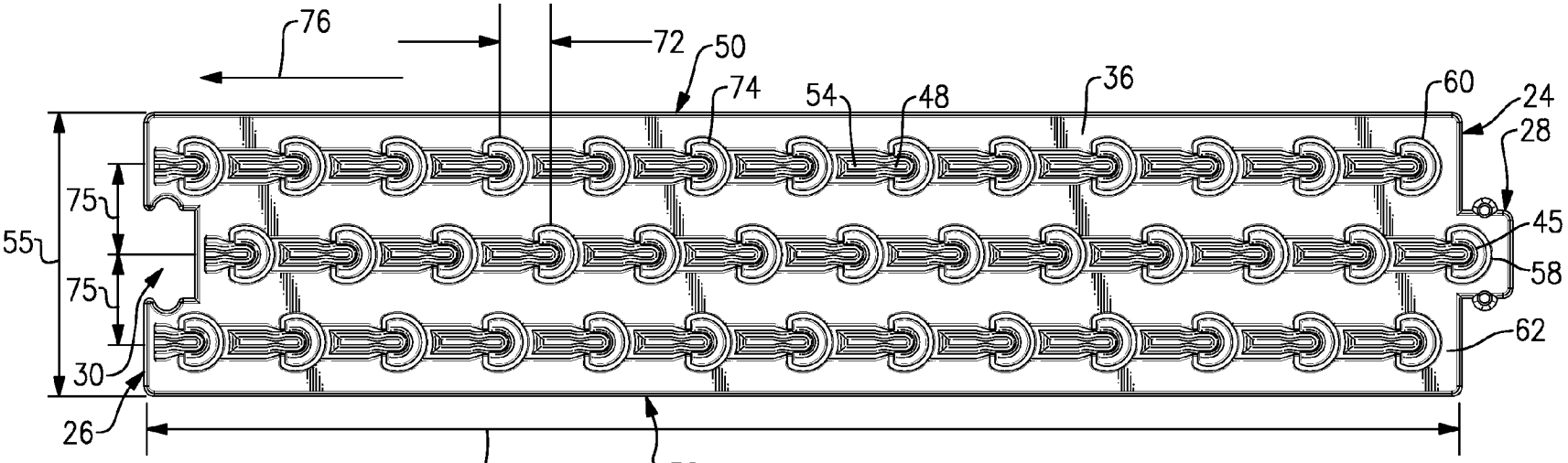
FIG. 5 is a top view of an example loom.
Figure 6:
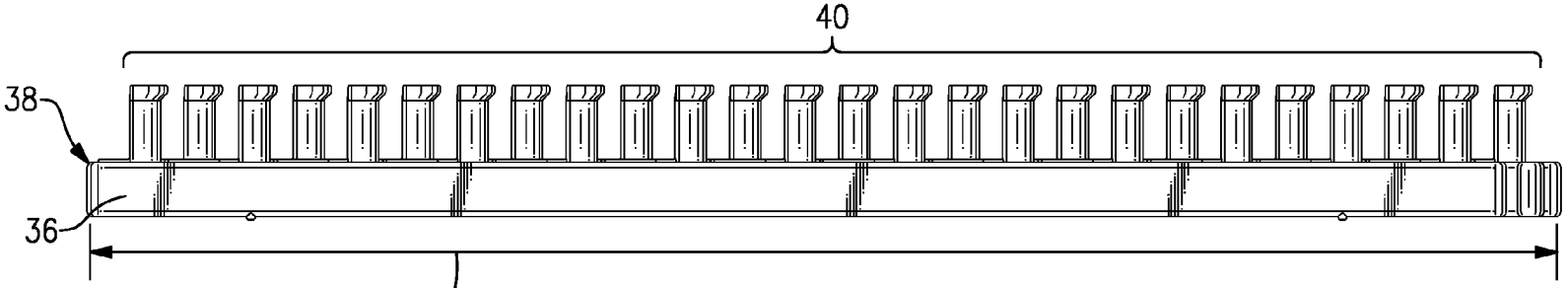
FIG. 6 is a side view of the example loom.

Referring to FIGS. 5 and 6 with continued reference to FIGS. 3 and 4. The base 36 includes a length 56 and a width 55. The base 36 includes a first end 24, a second end 26, a first side 50 and a second side 52. The pins 40 stand up from the base 36. Each of the pins 40 includes a body portion 46 including on one side an access groove 48 extending through the top surface 42 and flange 44. The body portion 46 includes a rounded shape on a side opposite the access groove 48 for supporting an elastic band. Each of the access grooves 48 is open in a common direction 76. In the disclosed example, the access grooves all point toward the second end 26. An opening 74 partially surrounds each pin 40 and extends through the first surface 38 of the base 36.

Figure 7:
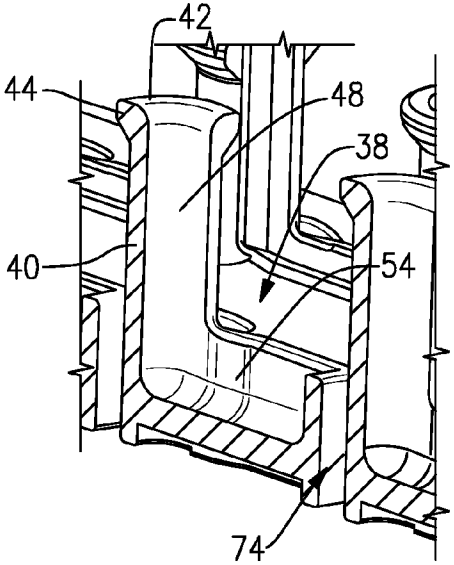
FIG. 7 is a sectional view through a pin of the example loom.

Referring to FIG. 7, with continued reference to FIGS. 4, 5 and 6, the base 36 includes slots 54 that extend below the first surface 38 and that are in communication with a corresponding one of the access grooves 48. The slot 54 provides for the hook 66 to extend below the first surface 38 to capture a bottom or lower most elastic band supported on the pin 40. During fabrication of a linked article, one elastic band is captured and pulled upward within another elastic band supported on a common pin 40. The hook 66 can therefore extend through the access groove 48 into the slot 54 to capture a lower most elastic band and pull that elastic band through the slot 54 and an upper elastic band. The slot 54 extends forward from the pin 40 and access groove 48.

The plurality of pins 40 are arranged in rows that extend a longitudinal length 56 of the loom 22 between the first end 24 and the second end 28. In this disclosed example, the rows include at least one center or intermediate row 58 disposed between an outer first row 60 and an outer second row 62. The intermediate row 58 and first and second outer rows 60,62 are spaced apart from each other in a direction transverse to the longitudinal length 56 an equal distance 75. The intermediate row 58 is staggered or offset relative to the first and second rows 60, 62 on each side. Accordingly, in this example, the intermediate row 58 includes pins 40 that are staggered or offset a distance 72 longitudinally relative to pins 40 in the first outer row 60 and the second outer row 62. The intermediate row 58 in the disclosed example includes a single pin 45 that is spaced forward of the other pins 40 at the first end 24.

Each of the slots 54 and access grooves 48 for each of the pins 40 face in a common direction 76. The common direction 76 in the disclosed loom 22 is toward the second end 26 and away from the first end 24.

Figure 8:
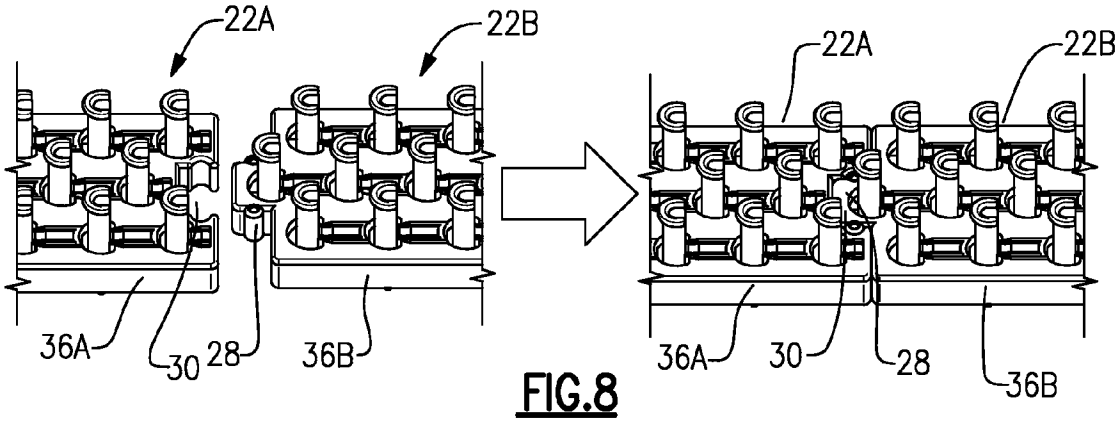
FIG. 8 is a schematic view of a connection between two looms.

Referring to FIG. 8, with continued reference to FIG. 5, the base includes a tab 28 on the first end 24 and a slot 30 on a second end 26 for connecting the base 36A of one loom 22A with the base 36B of another or second loom 22B. Connection of multiple looms 22 provides additional possible link combinations and lengths. In this example, the tab 28 and slot 30 are provided on respective first and second ends 24, 26; however, such connecting features are also contemplated on the first and second sides 50, 52.

Figure 10:
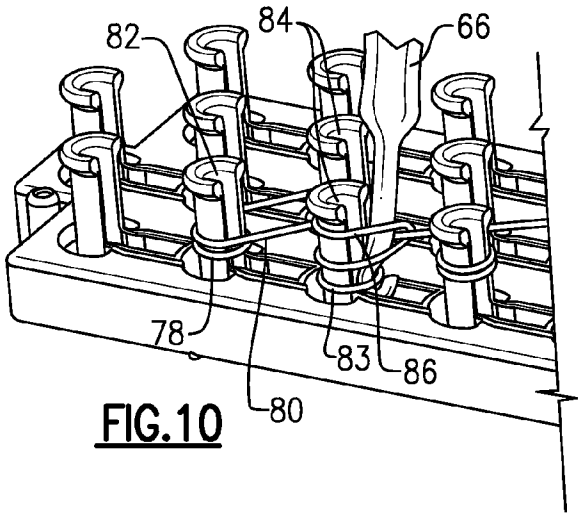
FIG. 10 is a schematic view of a second position for capturing an elastic band.
Figure 9:
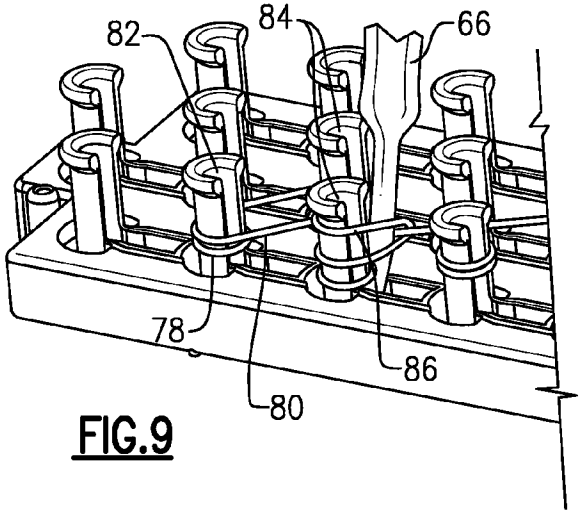
FIG. 9 is a schematic view of a first position for capturing an elastic band.

Referring to FIGS. 9 and 10 with continued reference to FIGS. 3-7, the slots 54 provide for the hook 66 to pick and engage an elastic band in two positions. One position, shown in FIG. 9, is with the hook 66 facing into the access groove 48. A second position, shown in FIG. 10, is with the hook 66 facing outward from the access groove 48. The slot 54 within the base 36 is in direct communication with the access groove 48 so that the hook 66 can move from the access groove 48 into the slot 54 under a lower most elastic band 83 supported on the pin 40. The lower most elastic band 83 can then be pulled through the access groove 48 and through upper elastic bands supported on the same pin 40.

A disclosed method of creating a linked item utilizing the loom 22 includes the step of stretching a first elastic band 78 across adjacent first and second pins 82, 84. The flange 44 holds the elastic band 78 on the first and second pins 82, 84 and prevents the elastic band from slipping off. A second elastic band 80 is stretched across second pin 84 and a third pin 86. The second elastic band 80 is supported on the second pin 84 above the first elastic band 78. A link is formed by capturing and pulling an end of the first band 78 through the access groove and the second band 80 and placing the captured end onto an adjacent pin that in this example is the first pin 82. This forms the Brunnian link and holds the link in place so that additional links can be formed and joined to existing links.

The hook 66 is utilized to capture ends of an elastic band and is inserted through the access groove 48 into the slot 54 and below the lower most elastic band that in this example is the first band 78. The hook 66 is used to grasp the elastic band 78 and pull the elastic band upward through the access groove 48 and within an elastic band above the lower elastic band to form the Brunnian link. The captured end of one of the plurality of elastic bands is pulled over the other end and captured on an adjacent pin while engaged with a second one of the plurality of elastic bands. Capturing and pulling subsequent ends of different ones of the plurality of elastic bands is repeated to form the desired link pattern.

Accordingly, the example kit and method provide for the creation of many different combinations and configurations of Brunnian links for the creation of bracelets, necklaces, and other linked items. Moreover, the example kit is expandable to further create and expand the capabilities of potential Brunnian link creations. The example kit provides for the creation of such links and items in an easy manner allowing persons of varying skill levels to be successful in creating unique wearable items.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A loom for creating an item consisting of a series of links, the device comprising:

a base having a length and width; and a plurality of pins standing up from the base, each of the plurality of pins respectively include a flange near a top surface for holding an elastic link in a desired orientation, and an access groove extending through the top surface, wherein the access groove in each of the plurality of pins faces in a common direction and are arranged in at least three rows spaced a common distance apart in a direction transverse to the length.

2. The loom as recited in claim 1, wherein the base includes a slot open to the access groove that extends below a first surface of the base to provide access for a tool below the first surface.

3. The loom as recited in claim 1, wherein the common direction is in a direction transverse to the width of the base.

4. The loom as recited in claim 2, wherein the access grooves are orientated in a direction common with the corresponding slot.

5. The loom as recited in claim 1, wherein the access grooves are orientated in a direction parallel with the length.

6. The loom as recited in claim 1, wherein pins in at least one of the at least three rows include pins that are not aligned in a direction parallel with a width of the base with pins in adjacent ones of the at least three rows.

7. The loom as recited in claim 6, wherein that at least three rows includes at least one intermediate row disposed between outer rows.

8. The loom as recited in claim 7, wherein the intermediate row includes pins not aligned with pins in the outer rows.

9. The loom as recited in claim 8, wherein the outer rows are spaced a common distance from the at least one intermediate row.

10. The loom as recited in claim 1, wherein the loom includes a first end spaced apart from a second end and the access groove for each of the plurality of pins opens toward the first end.

11. The loom as recited in claim 1, wherein the flange extends about the pin from a first side of the access groove to a second side of the access groove.

12. The loom as recited in claim 11, wherein the access groove extends through the flange and the top surface.

13. The loom as recited in claim 1, wherein the base includes at least one mating feature for connecting a first base of a first loom to a second base of a second loom.

14. The loom as recited in claim 13, wherein the at least one mating feature is disposed on at least one of a first end and a second end of the first base and the second base.

* * * * *